United States Patent [19]

Gosser

[11] 3,989,338

[45] Nov. 2, 1976

[54] PUSH-PIN ASSEMBLY METHOD AND CONSTRUCTION

[76] Inventor: Robert B. Gosser, 104 Del Drive-Linmor Acres, Irwin, Pa. 15642

[22] Filed: Nov. 8, 1974

[21] Appl. No.: 522,240

[52] U.S. Cl. ..... 339/96; 29/268; 29/625; 35/19 A; 174/112; 339/113 R

[51] Int. Cl.[2] ..... H01R 13/62

[58] Field of Search ..... 339/96, 113; 29/625, 29/268; 35/19 A; 40/316; 116/114 AJ; 174/112

[56] References Cited

UNITED STATES PATENTS

| | | | |
|---|---|---|---|
| 2,883,447 | 4/1959 | Dahl | 317/101 CE |
| 3,076,230 | 2/1963 | Parker et al. | 29/407 |
| 3,133,773 | 5/1964 | Ecker | 339/96 |
| 3,235,797 | 2/1966 | Boscia et al. | 339/113 B |
| 3,456,232 | 7/1969 | Dupre | 339/96 |
| 3,571,779 | 3/1971 | Collier | 339/96 |

FOREIGN PATENTS OR APPLICATIONS

| | | | |
|---|---|---|---|
| 931,657 | 7/1963 | United Kingdom | 339/221 R |
| 1,067,664 | 5/1967 | United Kingdom | 174/112 |

*Primary Examiner*—Joseph H. McGlynn

[57] ABSTRACT

Each of an array of holes for accepting insertion of push-pins, as in pinboards, connectors, etc. for multi-strand electrical and/or optical assemblies, is covered with a pin-penetrative membrane area having a hole-identifying marking thereon. Each such hole-covering membrane area preferably has either a see-through characteristic or suitable marking to enable locating and/or determining the size and shape of the respective membrane-covered hole. The respective push-pins with wires or light pipes attached, as the case may be, are punched through the numbered areas of the membrane into the holes for assembly of the pinboard, connector, or other push-pin-utilizing component.

9 Claims, 5 Drawing Figures

FIG. 1
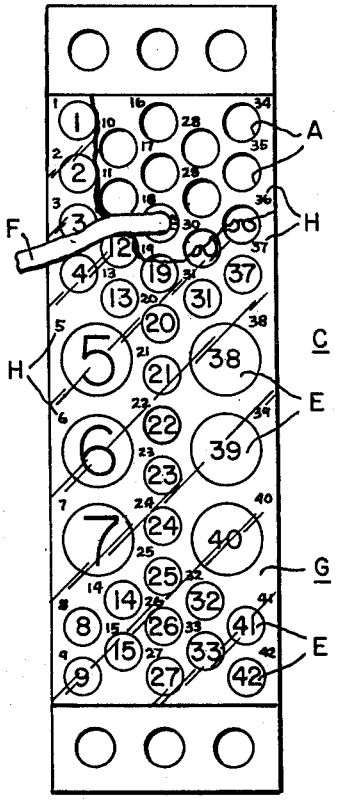
FIG. 2
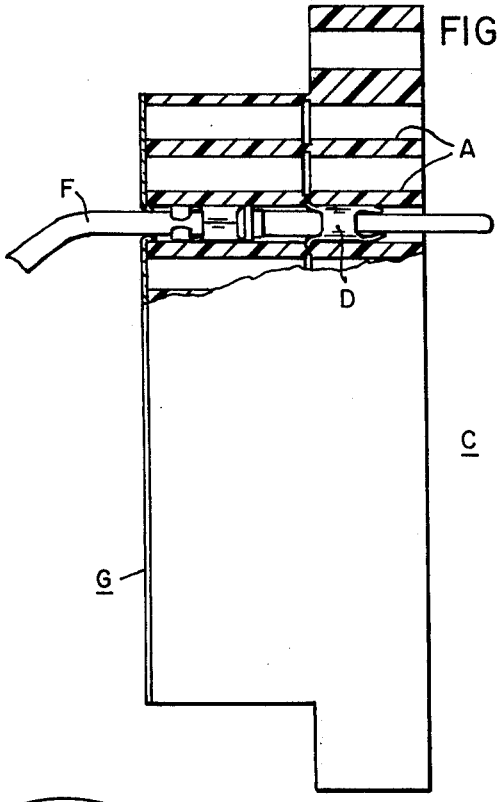
FIG. 3
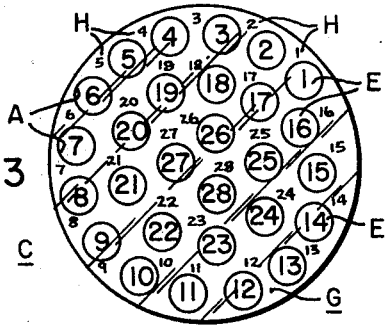
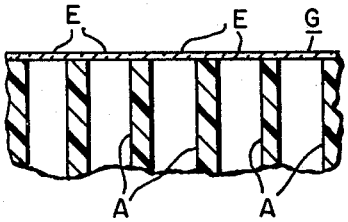
FIG. 4
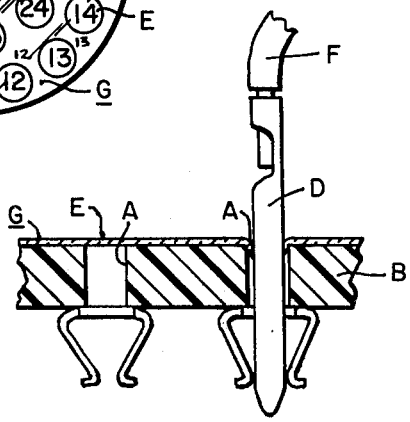
FIG. 5

PUSH-PIN ASSEMBLY METHOD AND CONSTRUCTION

BACKGROUND OF THE INVENTION

1. Field of the Invention

Push-pin assemblies.

2. Description of the Prior Art

In electrical wiring where a number of wires terminate at a pinboard or at the separable halves of a connector, it has been convenient to employ push-pin assemblies that afford a high degree of convenience in a space-saving manner. The push-pins are mechanically and electrically joined to the ends of the wires and such pins are then inserted into repective holes in the pinboard or connector member, where they become locked in place by virtue of spring-like locking members affiliated with the pins and locking shoulders formed in the holes into which such pins are inserted. In the case of connectors, the pin-receiving holes extend through the connector members and the push-pins of the one half, the male half, project beyond the joining face, while the push-pins of the other half, female are hollow-ended and terminate near the respective joining face for receiving the male-half pins, respectively.

In behalf of providing a compact assemblage, the pin-accommodating holes frequently are closely spaced where the number of wires to be accommodated is relatively great, and since it is necessary to be able to identify the holes into which the wires are assembled, numbers, or letters, appear, usually as molded integral portions, on the hole-bearing member in the narrow spaces between such holes. In most cases such number or letter markings are small and hence they tend to be somewhat obscure. A certain degree of care and skill becomes necessary in order to compensate for the obscurity of the markings in effecting error-free assembly of these prior art push-pin assemblies.

SUMMARY OF THE INVENTION

The present invention, in providing a hole-identifying character or marking in the hole area in which the push-pin is to be inserted, in most cases provides more prominent identification of such hole, since the area of the hole-covering membrane available for placement of the hole-identifying marking is greater than the between-hole areas in the closely spaced push-pin assemblies. In addition, use of a hole-identifying overlay membrane on the push-pin-accepting component affords opportunity for use of the same component in different wiring situations, with different numbers or markings for the same holes to suit the case.

BRIEF DESCRIPTION OF THE DRAWING

In the drawing:

FIGS. 1 and 2 are rear and side views, respectively, of a typical male part of a push-pin connector embodying the present invention;

FIG. 3 is a rear view of a circular push-pin connector member embodying the invention;

FIG. 4 is a fragmental view in cross-section showing the hole-identifying membrane of the present invention covering the pin-accepting ends of holes identified by such membrane; and FIG. 5 is a similar view of a pinboard embodying the invention.

DESCRIPTION OF THE PREFERRED EMBODIMENTS

Referring to the drawing, in accord with the present invention, each of an array of holes A for accepting insertion of push-pins D, (as in a pinboard B, a connector half C, which may be rectangular as in FIGS. 1 and 2, or circular as in FIG. 3, etc.), for a multi-strand electrical and/or optical assembly, is covered with a pin-penetra tive membrane area E having a hole-identifying marking thereon, such as the numerals shown in the drawing. Each such hole-covering membrane area preferably has either a see-through characteristic or a suitable marking to enable locating and/or determining the size and shape of the respective hole it covers. The respective push-pins D with wires F or light pipes (not shown) attached or formed on the ends thereof, as the case may be, are punched through the numbered areas E of the membrane into the holes A for assembly of the pinboard B, connector half C, or other push-pin-utilizing component (not shown). The hole-identifying membrane areas E initially covering the holes prior to insertion of the push-pins D can be formed integrally with the member, but as shown are formed as parts of a single membrane sheet G covering the entire pin-insertion-accommodating face of the respective member utilizing the invention, and this membrane sheet may be of the pressure sensitive type to facilitate its use. Since it is the underside of such membrane that has the adhesive layer on it, insertion of the pin through the upper non-adhesive-bearing surface of the membrane discourages adherence of any such adhesive material on the pin which might tend to corrupt its function as an electrical or optical conductor, as the case may be, but, if necessary, such adhesive need not be present in the hole areas. Hole-identifying numerals H molded in the member beside the holes as in the prior art, also may be included with the present invention.

I claim as my invention:

1. A member having a plurality of holes therein for accepting a plurality of separate push-pins, respectively, and push-pin-penetratable membrane areas bearing hole-identifying markings extending across the aforesaid holes, respectively, said markings being different, each hole with respect to others.

2. The assembly of claim 1, wherein said membrane areas bears hole-locating markings in addition to the hole-identifying markings.

3. The assembly of claim 1, wherein said membrane areas have a see-through characteristic for hole location.

4. The assembly of claim 1, wherein said member forms part of an electrical connector.

5. The assembly of claim 1, wherein said member forms part of a light pipe connector.

6. The assembly of claim 1, wherein said membrane areas are part of a common membrane.

7. The assembly of claim 6, wherein said common membrane is of the pressure sensitive type.

8. A method of facilitating location and insertion of separate push-pins in a member having a plurality of holes for accepting such push-pins, which method comprises the step of placing onto such member a push-pin-penetratable membrane having hole-identifying markings overlying such holes, respectively, said markings being different, each hole with respect to others.

9. The method of claim 8 wherein such membrane is of the pressure sensitive type that includes a backing of adhesive.

* * * * *